US007341139B2

(12) United States Patent
Aulanko et al.

(10) Patent No.: US 7,341,139 B2
(45) Date of Patent: Mar. 11, 2008

(54) TRAVELATOR, MOVING RAMP OR ESCALATOR

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/498,263

(22) Filed: Aug. 3, 2006

(65) Prior Publication Data

US 2007/0029163 A1 Feb. 8, 2007

Related U.S. Application Data

(63) Continuation of application No. PCT/FI2005/000043, filed on Jan. 21, 2005.

(30) Foreign Application Priority Data

Feb. 3, 2004 (FI) ..... 20040167

(51) Int. Cl.
*B66B 23/04* (2006.01)

(52) U.S. Cl. ..... 198/335; 198/336; 198/337

(58) Field of Classification Search ..... 198/329, 198/335, 336, 337
See application file for complete search history.

(56) References Cited

U.S. PATENT DOCUMENTS

| | | | | |
|---|---|---|---|---|
| 900,000 | A | 9/1908 | Seeberger | |
| 1,025,316 | A | 5/1912 | Seeberger | |
| 2,578,592 | A * | 12/1951 | Pile | 198/833 |
| 2,940,578 | A | 6/1960 | Clemetsen | |
| 3,283,878 | A | 11/1966 | Rissler | |
| 3,314,517 | A | 4/1967 | Karr | |
| 3,399,758 | A | 9/1968 | Karr | |
| 3,583,325 | A | 6/1971 | Melin et al. | |
| 3,595,364 | A * | 7/1971 | Schoneweiss | 198/335 |
| 3,623,589 | A * | 11/1971 | Johnson | 198/335 |
| 4,232,776 | A | 11/1980 | Dean | |

(Continued)

FOREIGN PATENT DOCUMENTS

| | | |
|---|---|---|
| DE | 2 239 982 | 3/1974 |

(Continued)

*Primary Examiner*—Douglas A Hess
(74) *Attorney, Agent, or Firm*—Venable LLP; Robert Kinberg

(57) ABSTRACT

A travelator, moving ramp or escalator for transporting people, comprises a people mover; a balustrade extending alongside the people mover throughout its length. The balustrade comprises a handrail belt formed as an endless loop and having an upper handhold portion, which the passenger can grasp with a hand for support, a lower return portion, and a turn-around portion between the handhold portion and the return portion. The balustrade frame comprises a turn-around guide at the end of the balustrade to form a turn-around to support and guide the turn-around portion of the handrail belt. The turn-around guide comprises a number of pressure rollers spaced at a distance from each other and arranged in a sequence in the form of a circular arc. In addition, a drive assembly is arranged to move the handrail belt. The drive assembly comprises a drive belt formed as an endless loop and having a contact portion which is in driving contact with the handrail belt over a predetermined length, and a power mechanism for driving the drive belt. The contact portion of the drive belt is passed over the sequence of pressure rollers between the pressure rollers and the turn-around portion of the handrail belt.

14 Claims, 3 Drawing Sheets

U.S. PATENT DOCUMENTS

| | | | | | |
|---|---|---|---|---|---|
| 4,240,537 | A | | 12/1980 | Dunstan | |
| 4,895,240 | A | | 1/1990 | Bruehl et al. | |
| 5,117,960 | A | * | 6/1992 | Ahls et al. | 198/335 |
| 5,181,595 | A | * | 1/1993 | Tietze et al. | 198/335 |
| 5,207,308 | A | * | 5/1993 | Sheffield et al. | 198/336 |
| 5,477,954 | A | * | 12/1995 | Greutter et al. | 198/335 |
| 5,634,546 | A | * | 6/1997 | Ostermeier et al. | 198/335 |
| 5,638,937 | A | * | 6/1997 | Birney et al. | 198/335 |
| 5,881,859 | A | * | 3/1999 | Bianchi | 198/335 |
| 6,102,186 | A | | 8/2000 | Pallinger et al. | |
| 6,161,674 | A | | 12/2000 | Aulanko et al. | |
| 6,199,678 | B1 | | 3/2001 | Reo | |
| 6,640,959 | B1 | | 11/2003 | Haumann et al. | |
| 6,991,084 | B2 | | 1/2006 | Lunardi et al. | |
| 7,255,217 | B2 | | 8/2007 | Novacek et al. | |

FOREIGN PATENT DOCUMENTS

| | | | |
|---|---|---|---|
| GB | 2205803 | A | 12/1988 |
| GB | 2252287 | A | 5/1995 |
| WO | WO 89/05771 | | 6/1989 |
| WO | WO 2005/075332 | A2 | 8/2005 |
| WO | WO 2005/075332 | A3 | 8/2005 |

* cited by examiner

TRAVELATOR, MOVING RAMP OR ESCALATOR

CROSS-REFERENCE TO RELATED APPLICATIONS

This application is a continuation of International Application No. PCT/FI2005/000043 filed Jan. 21, 2005, designating the United States and claiming priority from Application NO. FI20040167 filed in Finland on Feb. 3, 2004. The disclosures of both foregoing applications are incorporated herein by reference along with each and every U.S. and foreign patent and patent application mentioned herein below.

BACKGROUND OF THE INVENTION

The present invention relates to a travelator, moving ramp or escalator.

Travelators, moving ramps or escalators wherein people are transported on a conveyor horizontally or at an upward/downward angle are disclosed for example in International Patent Application Publication No. WO 02/26612 and U.S. Pat. No. 5,117,960. Such a travelator or escalator comprises a people mover and a balustrade extending alongside the people mover throughout its length. The balustrade comprises a handrail belt implemented as an endless loop. The passenger can grasp the upper handhold portion of the handrail belt for support. The lower return portion is hidden from view, running inside the frame structure of the travelator or escalator. The balustrade further comprises a balustrade frame, which comprises a turn-around guide placed at the end of the balustrade to form a so-called turn-around and to support and guide the turn-around portion of the handrail belt so as to allow the direction of motion of the handrail belt to be turned through 180°.

As explained in U.S. Pat. No. 5,477,954 and U.S. Pat. No. 5,634,546, the turn-around guide forming the turn-around usually comprises a number of spaced apart pressure rollers arranged in a sequence in the form of an arc of about 180°.

Referring again to International Patent Application Publication No. WO 02/26612 and U.S. Pat. No. 5,117,960, the handrail belt is driven by a drive assembly comprising a drive belt formed as an endless loop. The drive belt is in driving contact with the handrail belt over a predetermined length, which in this description is called contact portion. The drive belt is driven by a power means.

International Patent Application Publication No. WO 02/26612 discloses a system in which a drive belt functions as the drive element of both the people mover and the handrail belt. The drive belt is in contact with the visible outer side of the handrail belt within its straight return portion, and pressure rollers are provided on the opposite inner side of the handrail belt. As the driving force of the drive belt acts on the visible outer side of the handrail belt, WO 02/26612 discloses that the handrail belt should be made of a durable material to prevent damage. The problem is that a handrail belt manufactured from special materials is expensive. Moreover, the current type of driving solution used to drive the handrail belt is not applicable for use in travelators, moving ramps or escalators in which the frame is intended to have as low a construction height as possible and which are designed to be mounted on a fixed base without a pit formed in the fixed base.

U.S. Pat. No. 5,117,960 discloses an arrangement for driving the handrail belt by a drive belt engaging the return portion of the handrail belt directly. The handrail belt is driven as it is passing through a nip formed by the two belts. The contact portion of the drive belt is in contact with the inner side of the handrail belt, i.e. with the bottom of the groove in the belt. The drive belt is pressed against the handrail belt by a plurality of springloaded pressure rollers. On the opposite side of the handrail belt is a second, freely running pressure belt which is passed over deflection and pressure rollers and implemented as an endless loop which contacts the visible outer side of the handrail belt. A problem with this solution is that the handrail belt is subject to pressing forces that may cause fatigue of the belt material in the course of time. The pressure belt contacting the visible outer side of the handrail belt causes wear of the handrail belt. In addition, in order to achieve a sufficient driving force, the pressure belt and its deflection and pressure rollers are necessarily needed, which leads to a massive and expensive construction.

SUMMARY OF THE INVENTION

An object of the present invention is to overcome the above-mentioned drawbacks.

A more specific object of the invention is to provide a simple and inexpensive solution for driving a handrail belt.

A further object of the invention is to provide a solution for driving a handrail belt that does not cause wear of the handrail belt, thus allowing the service life of the handrail belt to be extended.

A further object of the invention is to provide a drive solution that takes up as little space as possible and is applicable for use in travelators, moving ramps or escalators that are intended to have a frame of as low a construction height as possible and to be mounted on a fixed base without a pit formed in the fixed base.

The above and other objects are accomplished according to the invention wherein there is provide in one exemplary embodiment a travelator, moving ramp or escalator for transporting people, comprising: a people mover; a balustrade extending alongside the people mover throughout its length, the balustrade comprising: a handrail belt comprising an endless loop and having an upper handhold portion, which a passenger can grasp with a hand for support, a lower return portion, and a turn-around portion between the handhold portion and the return portion; a balustrade frame comprising a turn-around guide arranged at an end of the balustrade to support and guide the turn-around portion of the handrail belt, the turn-around guide comprising a number of pressure rollers spaced apart by a distance from each other and arranged in a sequence having a form of a circular arc; and a drive assembly operatively arranged to move the handrail belt, the drive assembly comprising: a drive belt comprising an endless loop having a contact portion in driving contact with the handrail belt over a predetermined length; and a power mechanism to drive the drive belt, wherein the contact portion of the drive belt is passed over at least some of the pressure rollers of the turn-around guide, between the pressure rollers and the turn-around portion of the handrail belt.

The invention is based on the insight that a handrail belt under normal tension can be driven by utilizing the pressure rollers already existing in the turn-around guide, by passing the drive belt between them and the handrail belt. As the handrail belt is pressed with a sufficient force against the drive belt in the turn-around portion due to its normal tension, it is not necessary to provide any counter-support on the outer side of the handrail belt, thus allowing an inexpensive, simple and compact drive solution to be achieved.

A handrail belt manufactured from conventional materials can be used, and its wear is reduced and its service life increased. The drive solution of the invention is particularly well suited for use in travelators, moving ramps or escalators in which the frame is intended to have as low a construction height as possible and which are designed to be mounted on a fixed base without a pit formed in the fixed base.

In an an exemplary embodiment of the invention, the pressure rollers are arranged in a sequence forming a circular arc of about 180°.

In another exemplary embodiment of the invention, the drive belt is passed substantially over all the pressure rollers.

In a further exemplary embodiment of the invention, the drive assembly comprises a deflection roller located at one end of the sequence of pressure rollers, and a driving roller located at the other end of the sequence of pressure rollers, wherein the driving roller is arranged to be rotated by a power mechanism.

In yet another exemplary embodiment of the invention, the deflection roller is placed at the upper end of the sequence of pressure rollers and the driving roller is placed at the lower end of the sequence of pressure rollers. In one advantageous exemplary embodiment, all the existing pressure rollers are utilized, because the larger the contact surface is, the less slippage will there occur between them and therefore the belts will undergo less wear due to slippage. If a sufficient frictional force is achieved, in some applications the drive belt may only be passed over some of the pressure rollers.

In another exemplary embodiment of the invention, the drive belt is implemented as an endless loop comprises a return portion which is opposite to the contact portion of the drive belt loop. The drive assembly may comprise a number of back-tension rollers, arranged in a sequence in the form of a circular arc at a distance from each other between the deflection roller and the driving roller close to the sequence of pressure rollers, the return portion of the drive belt being passed over these back-tension rollers. Using back-tension rollers, the drive belt and all the rollers can be encapsulated inside the narrow arc-shaped frame of the turn-around guide, so the appearance will not differ from currently used apparatus.

In a further exemplary embodiment of the invention, the drive belt is a toothed belt with toothing on the inner side of the drive belt loop. The driving roller is a sprocket. At least some of the pressure rollers are also sprockets.

In another exemplary embodiment of the invention, the handrail belt has a cross-section with a substantially C-shaped profile with an inner groove delimited by a bottom and side walls and which opens inwards into the handrail belt loop. The contact portion of the drive belt is in frictional contact with the bottom of the groove.

In another exemplary embodiment of the invention, the drive assembly for driving the handrail belt is disposed at the exit end of the travelator, moving ramp or escalator relative to the transport direction.

In a further exemplary embodiment of the invention, the drive assembly for driving the handrail belt is disposed at the entry and exit ends of the travelator, moving ramp or escalator.

In another exemplary embodiment of the invention, the turn-around guide comprises a frame to which the shafts of the pressure rollers, back-tension rollers, deflection roller and/or driving roller are connected.

In another exemplary embodiment of the invention, the travelator, moving ramp or escalator is a travelator, moving ramp or escalator of low construction height adpated to be mounted on a fixed base, such as a floor or other support.

BRIEF DESCRIPTION OF THE DRAWINGS

In the following, the invention will be described in detail with reference to a few examples of its embodiments and the attached drawing, wherein.

DESCRIPTION OF THE EXEMPLARY EMBODIMENT

Figure 1:
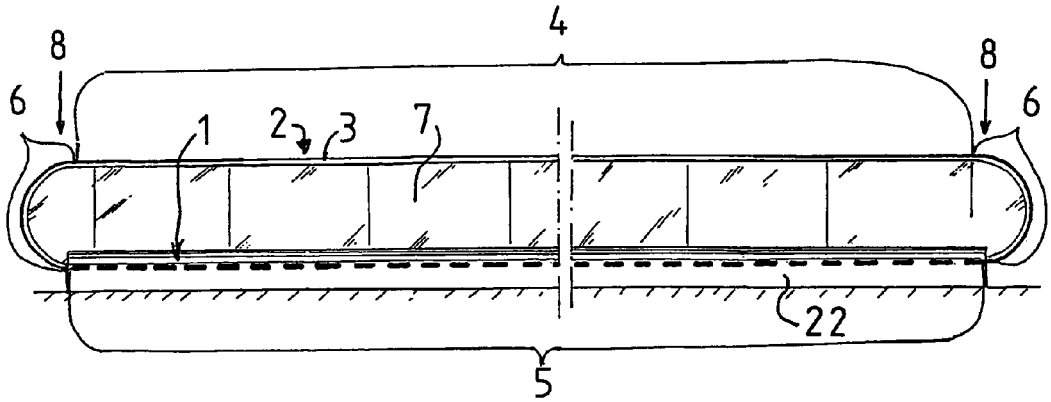
FIG. 1 presents a diagrammatic side view of an exemplary embodiment of the travelator of the invention.

FIG. 1 presents a travelator of a low construction height, designed to be mounted on a fixed base, such as a floor or other support, which means that no pit has to be made in the fixed base for the travelator machinery. In the following description of an exemplary embodiment, the invention is described with reference to a horizontal travelator, but it is obvious that corresponding principles of the invention can be applied to moving ramps and escalators as well.

The travelator comprises a people mover 1, which may be any applicable type of conveyor known to the person skilled in the art, e.g. a pallet conveyor or belt conveyor. The people mover 1 is mounted on a conveyor frame 22. The conveyor frame 22 lies on a floor throughout its length. Supported on the conveyor frame 22 are usually two balustrades 2, which extend along both sides of the people mover throughout its length.

Each balustrade 2 comprises a handrail belt 3 formed as an endless loop. The visible upper portion of the handrail belt loop 3, which runs in the transport direction of people mover 1 substantially at the same speed with it, is here called the handhold portion 4, which the passenger can grasp with a hand for support while traveling on the conveyor 1. The lower portion of the handrail belt loop 3, which runs in the opposite direction relative to the transport direction of the people mover 1 and is hidden from view inside the conveyor frame 22, is here called the return portion 5. The handrail belt loop 3 portion between the handhold portion 4 and the return portion 5, where the direction of motion of the handrail belt 3 is turned through 180°, is here called the turn-around portion 6.

The balustrade 2 comprises a balustrade frame 7, which is secured to the conveyor frame 22. Most of the surface area of the balustrade frame 7 is usually made of a transparent material, such as glass. At the end of the balustrade 2 is a turn-around guide 8, which supports the handrail belt loop from the inner side and guides the turnaround portion 6 of the handrail belt, which turns in the turn-around guide 8 through a 180° circular arc of a radius of about 500 mm. The turn-around guide 8 comprises a number of pressure rollers 9, which have been arranged as a sequence in the form of a 180° circular arc, spaced by a distance from each other.

Figure 2:
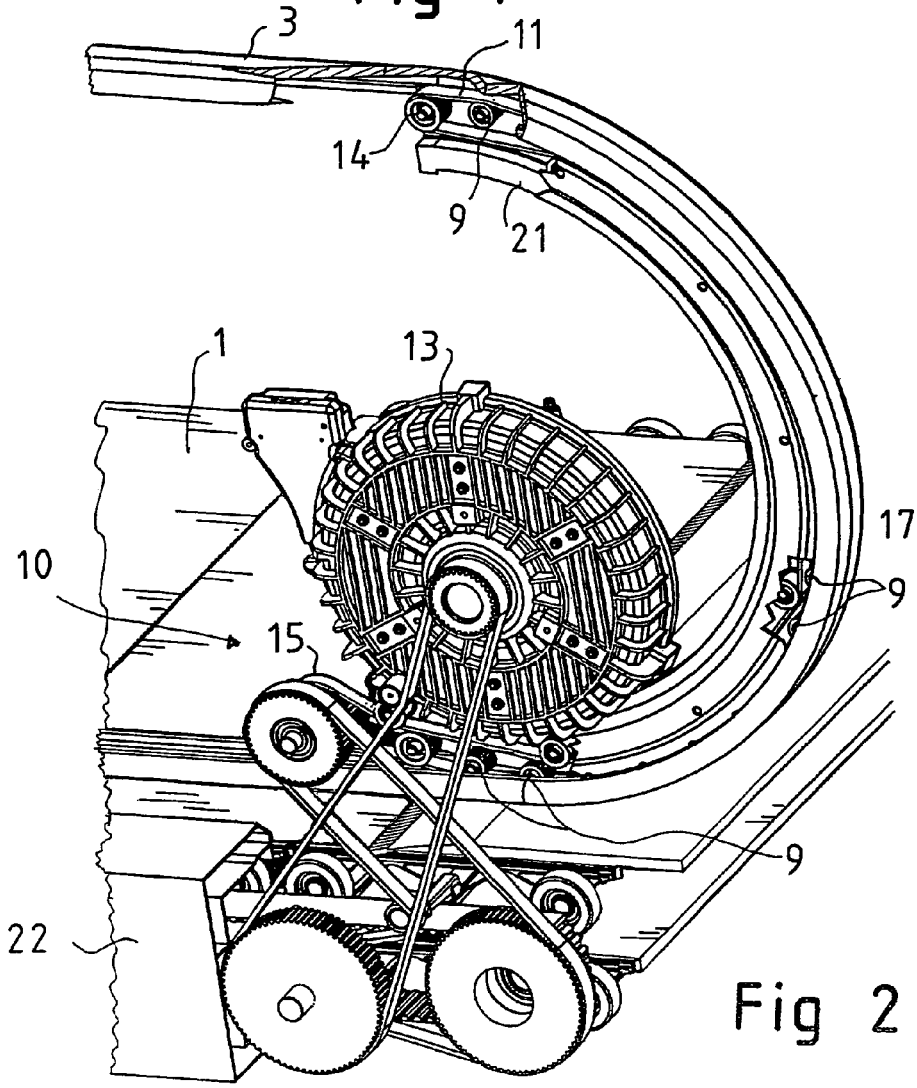
FIG. 2 presents an axonometric view of an arrangement for driving the conveyor and the handrail belt, disposed at the exit end of the travelator in FIG. 1.
Figure 3:
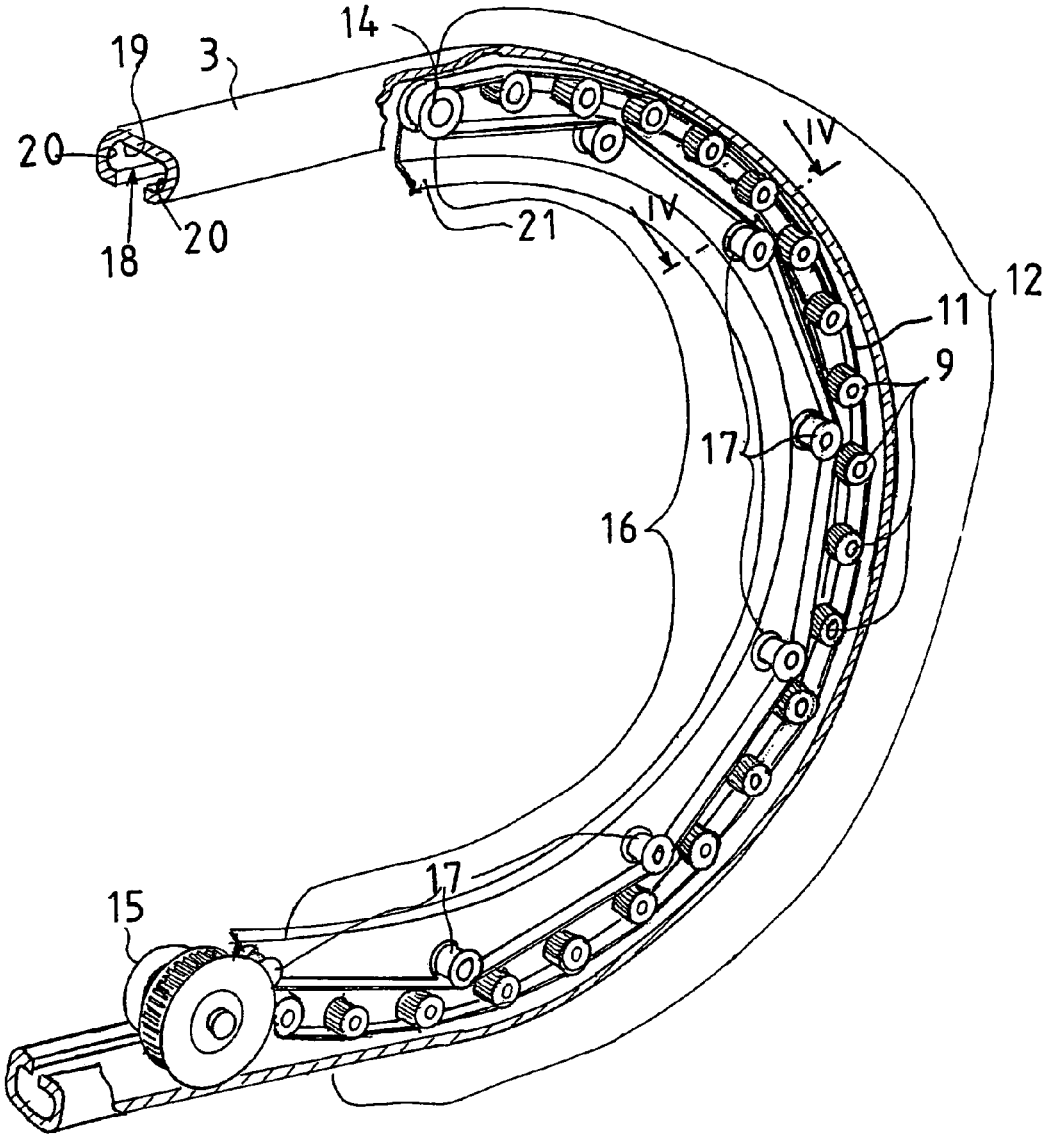
FIG. 3 presents a diagrammatic view of the arrangement for driving the handrail belt in FIG. 2.

With reference to FIGS. 2 and 3, a drive assembly 10, comprising a drive belt 11 formed as an endless loop and driven by a power mechanism 13 via a toothed belt transmission, is provided to move the handrail belt 3. In the example in FIG. 2, the power mechanism 13 is an electric motor, preferably an axial synchronous motor (KONE Eco-Disc®), provided with permanent magnets, which is disposed on one side of the balustrade 2 and, being of a flat construction, can be installed in a small space. The power mechanism 13 may also be any other suitable power source. In the example in FIG. 2, the power mechanism 13 has been arranged to drive the pallet conveyor 1 as well.

At the upper end of the sequence of pressure rollers 9 is a deflection roller 14 and at the lower end a driving roller 15, which is rotated by the power mechanism 13. The drive belt loop 11 comprises a portion which is here called the contact portion 12.

Figure 4:
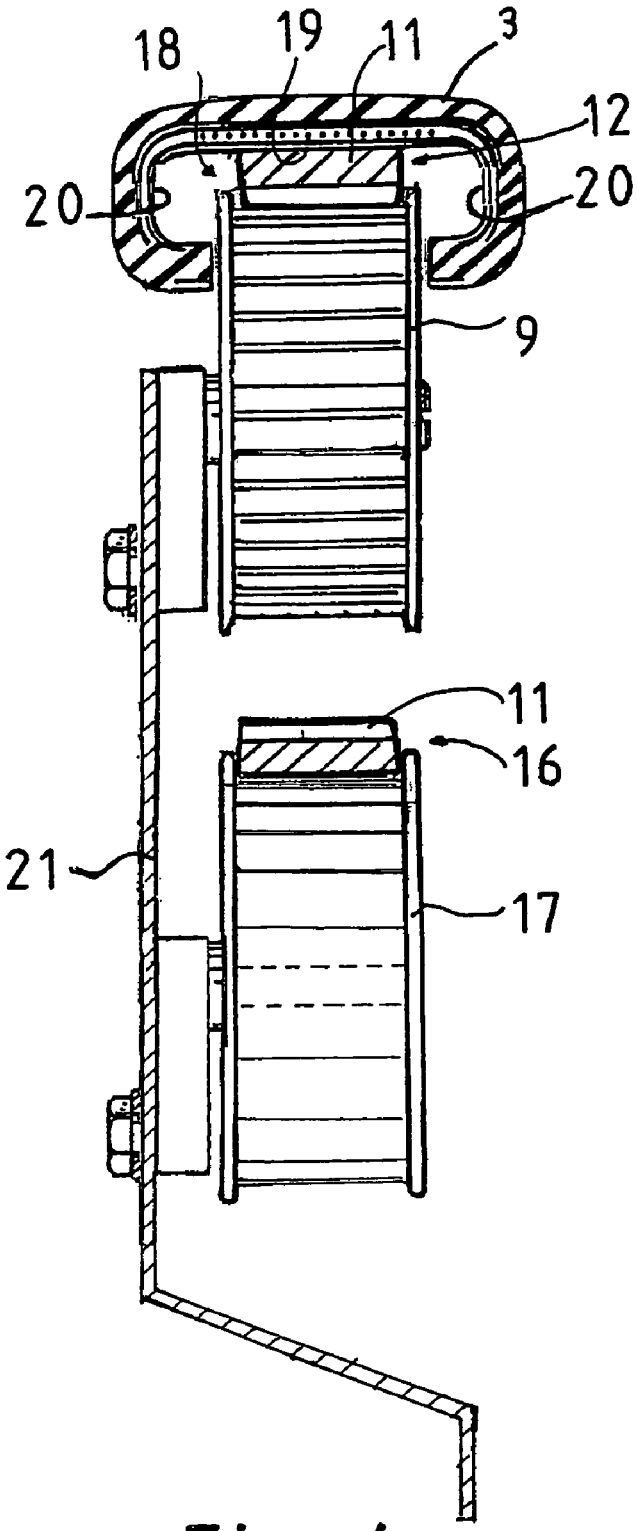
FIG. 4 presents a cross-section IV-IV through the arrangement in FIG. 3.

As can be seen especially from FIG. 3 and also from the cross-sectional view in FIG. 4, the contact portion 12 of the drive belt 11 is in driving frictional contact with the handrail belt 3. The contact portion 12 of the drive belt 11 is passed over all the pressure rollers 9 in the sequence of pressure rollers in the turn-around guide 8, between the pressure rollers 9 and the turn-around portion 6 of the handrail belt 3, so that the contact angle is a full 180°.

The drive belt 11 also comprises a return portion 16, which in the drive belt loop is on the opposite side relative to the contact portion 12 and in which the drive belt moves in the opposite direction relative to the direction of motion of the contact portion 12. A number of back-tension rollers 17, which is smaller than the number of pressure rollers 9, are arranged spaced by a distance from each other in a sequence having a form of a circular arc, between the deflection roller 14 and the driving roller 15 near the sequence of pressure rollers 9. The return portion 6 of the drive belt 11 is passed over the back-tension rollers 17.

The drive belt 11 is a toothed belt with toothing on the inner side of the drive belt loop. Therefore, at least the driving roller 15 is a toothed sprocket. The pressure rollers 9 may also be toothed sprockets.

Referring to FIGS. 3 and 4, the handrail belt 3 is a substantially C-shaped profile in cross-section, with an inner groove 18 which is delimited by a bottom 19 and side walls 20. The groove 18 opens inwards into the handrail belt loop 3. The contact portion 12 of the drive belt 11 is in driving frictional contact with the bottom 19 of the groove 18. The turn-around guide 8 comprises a frame 21, to which the shafts of the pressure rollers 9, back-tension rollers 17, deflection roller 14 and/or driving roller 15 are connected. The rollers are preferably plastic rollers, each being mounted with a bearing on a shaft, one end of which is secured to the frame 22.

The invention is not limited to the exemplary embodiments described above; instead, many variations are possible within the scope of the inventive concept defined in the claims.

What is claimed is:

1. A travelator, moving ramp or escalator for transporting people, comprising:

a people mover;

a balustrade extending alongside the people mover throughout its length, the balustrade comprising:

a handrail belt comprising an endless loop and having an upper handhold portion, which a passenger can grasp with a hand for support, a lower return portion, and a turn-around portion between the handhold portion and the return portion;

a balustrade frame comprising a turn-around guide arranged at an end of the balustrade to support and guide the turn-around portion of the handrail belt, the turn-around guide comprising a number of pressure rollers spaced apart by a distance from each other and arranged in a sequence having a form of a circular arc; and a drive assembly operatively arranged to move the handrail belt, the drive assembly comprising:

a drive belt comprising an endless loop having a contact portion in driving contact with the handrail belt over a predetermined length; and a power mechanism to drive the drive belt, positioned substantially within a horizontal projection of the loop of the handrail belt and on a side of the balustrade or at least partially inside the loop of the handrail belt, wherein the contact portion of the drive belt is passed over at least some of the pressure rollers of the turn-around guide, between the pressure rollers and the turn-around portion of the handrail belt.

2. The travelator, moving ramp or escalator according to claim 1, wherein the sequence of pressure rollers form a circular arc of about 180°.

3. The travelator, moving ramp or escalator according to claim 1, wherein the drive belt is passed substantially over all the pressure rollers.

4. The travelator, moving ramp or escalator according to claim 1, wherein the drive assembly comprises a deflection roller located at one end of the sequence of pressure rollers, and a driving roller located at the other end of the sequence of pressure rollers, the driving roller being arranged to be rotated by the power mechanism.

5. The travelator, moving ramp or escalator according to claim 4, wherein the sequence of pressure rollers have an upper end and a lower end, the deflection roller is placed at the upper end and the driving roller is placed at the lower end.

6. The travelator, moving ramp or escalator according to claim 4, wherein the drive belt endless loop includes a return portion opposite to the contact portion of the drive belt endless loop, and wherein the drive assembly further comprises a number of back-tension rollers arranged at a distance from each other and arranged in a sequence having a form of an arc between the deflection roller and the driving roller near the sequence of pressure rollers, the return portion of the drive belt endless loop being passed over the back-tension rollers.

7. The travelator, moving ramp or escalator according to claim 6, wherein the pressure rollers, back-tension rollers, deflection roller and driving roller each have shafts and the turn-around guide comprises a frame to which the shafts of the pressure rollers, back-tension rollers, deflection roller and driving roller are connected.

8. The travelator, moving ramp or escalator according to claim 1, wherein the drive belt endless loop comprises a toothed belt with toothing on an inner side of the drive belt endless loop; and the driving roller comprises a toothed sprocket operatively engaged with the toothed drive belt.

9. The travelator, moving ramp or escalator according to claim 8, wherein some of the pressure rollers are toothed sprockets.

10. The travelator, moving ramp or escalator according to claim 1, wherein the handrail belt has a cross-section with a substantially C-shaped profile having an internal groove delimited by a bottom and side walls and which opens inwardly into the handrail belt endless loop; and the contact portion of the drive belt is in frictional contact with the bottom of the groove.

11. The travelator, moving ramp or escalator according to claim 1, wherein the travelator, moving ramp or escalator has an exit end relative to a transport direction, and the drive assembly for driving the hand-rail belt is disposed at the exit end.

12. The travelator, moving ramp or escalator according to claim 1, wherein the travelator, moving ramp or escalator has an entry end and an exit end, and the drive assembly for driving the handrail belt is comprised of first and second ones of the drive assembly disposed at the entry and exit ends, respectively.

13. The travelator, moving ramp or escalator according to claim 1, wherein the travelator, moving ramp or escalator is a travelator, moving ramp or escalator of low construction height adapted to be mounted on a fixed base comprised of one of a floor or other support.

14. The travelator, moving ramp or escalator according to claim 1, wherein the power mechanism comprises a motor.

* * * * *